United States Patent [19]

Kirsch

[11] Patent Number: 4,928,831

[45] Date of Patent: May 29, 1990

[54] GARMENT-GREETING CARD COMBINATION

[76] Inventor: Carol L. Kirsch, 1638 Huntington Dr., Apt. C, S. Pasadena, Calif. 91030

[21] Appl. No.: 419,079

[22] Filed: Oct. 10, 1989

[51] Int. Cl.[5] ..... B65D 5/06

[52] U.S. Cl. ..... 206/575; 229/928; 206/232; 206/281

[58] Field of Search ..... 206/575, 232, 281, 278; 229/92.8; 40/586; 2/115

[56] References Cited

U.S. PATENT DOCUMENTS

| | | | |
|---|---|---|---|
| 1,879,007 | 9/1932 | Anderton . | |
| 2,010,830 | 8/1935 | Staudte . | |
| 2,461,430 | 2/1949 | Mack . | |
| 2,717,174 | 3/1955 | Casanovas | 229/92.8 |
| 2,997,226 | 8/1961 | Morris | 229/92.8 |
| 3,701,207 | 10/1972 | Conrad | 206/575 |
| 4,466,136 | 8/1984 | Bottom et al. . | |
| 4,493,650 | 1/1985 | Kaufmann, III et al. . | |
| 4,840,275 | 6/1989 | Faiola et al. | 206/575 |

*Primary Examiner*—Joseph Man-Fu Moy
*Attorney, Agent, or Firm*—Sheldon & Mak

[57] ABSTRACT

A novelty greeting card is provided wherein an item of wearing apparel is attached in combination with a stiffener element and the combination is folded so as to take on the appearance of a conventional greeting card. The item of wearing apparel is removable from the stiffener element so that it can be worn by one receiving the novelty greeting card.

14 Claims, 5 Drawing Sheets

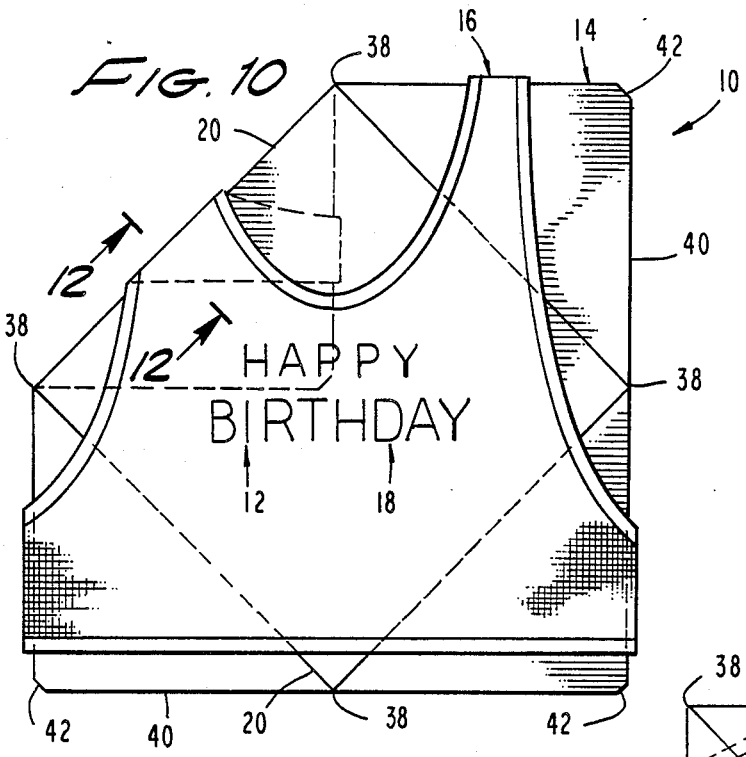
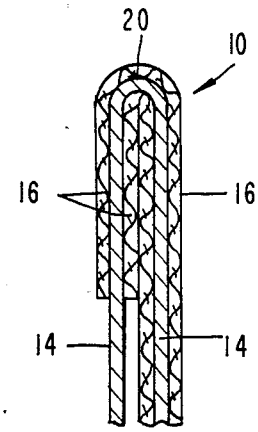
FIG. 12
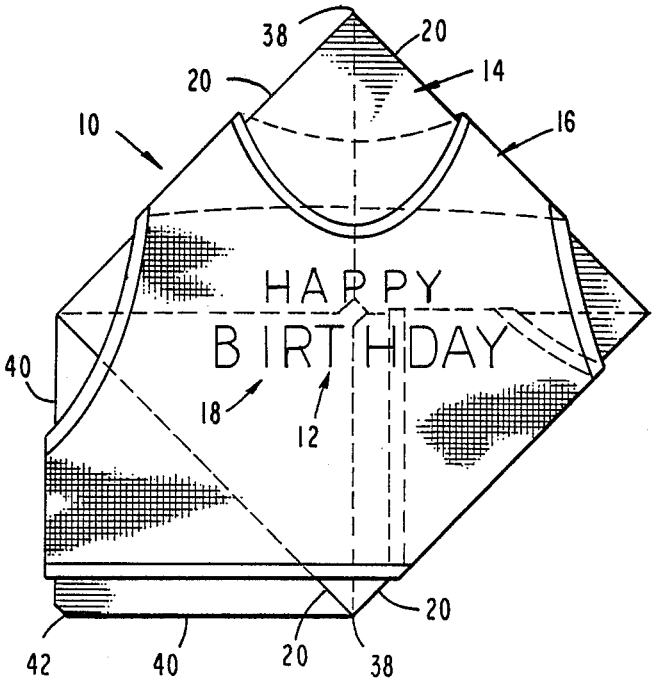
FIG. 11
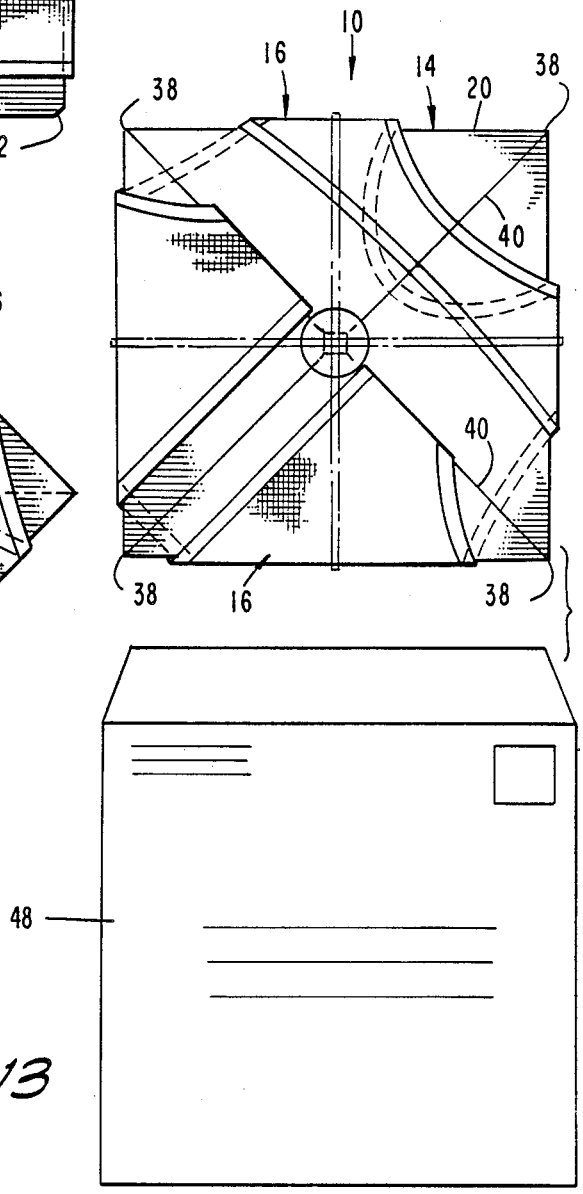
FIG. 13

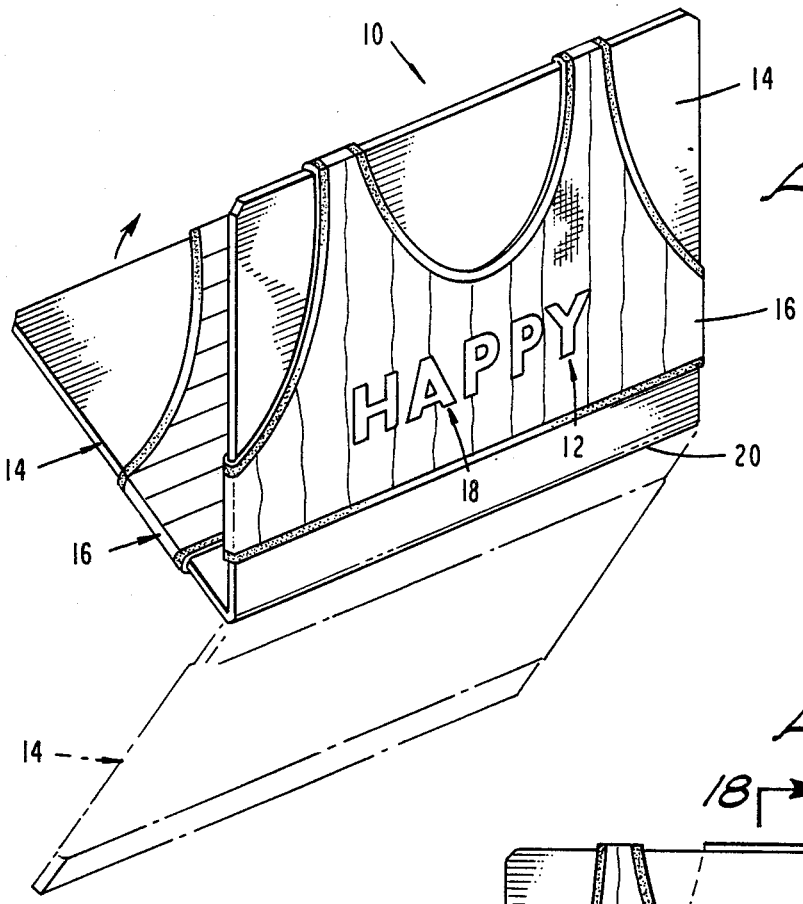
FIG. 16
FIG. 17
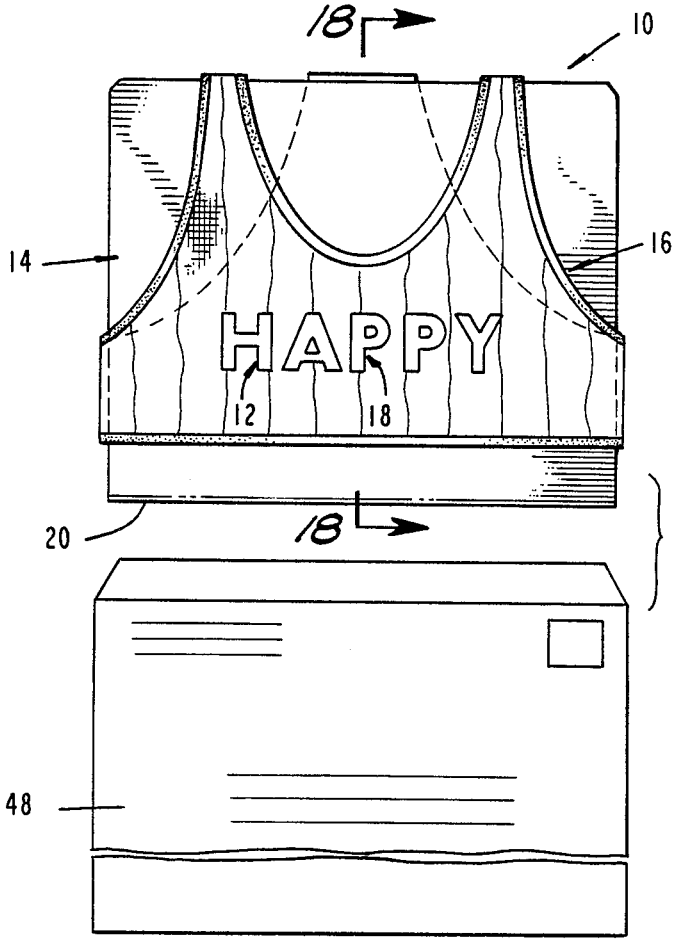
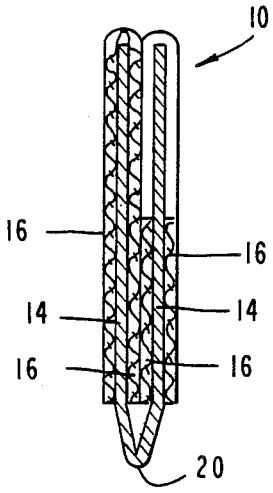
FIG. 18

GARMENT-GREETING CARD COMBINATION

BACKGROUND

This invention relates generally to greeting cards and specifically to novelty greeting cards which comprise an item of wearing apparel.

The consuming public's desire for new and unusual greeting cards and other message-bearing novelty items has increased geometrically over the last 20 years.

Also, the public's enjoyment of message-bearing T-shirts and other items of wearing apparel has greatly increased since the 1960's.

Unfortunately, there is no presently known device which uses a message-bearing item of wearing apparel as part of a novelty greeting card.

SUMMARY

The invention provides such a device.

The invention is a novelty greeting in which an item of wearing apparel, such as a T-shirt, comprises an integral part of the card. The invention can be mailed or otherwise delivered to a recipient in a fashion similar to that of a conventional greeting card, and, after receipt, the item of wearing apparel can be removed and worn by the recipient.

The novelty greeting card comprises the combination of a stiffener element disposed inside an item of wearing apparel. The stiffener element has at least one score line to facilitate the folding of the stiffener element. The item of wearing apparel comprises a wearing apparel design and the item of wearing apparel is attached to the stiffener element. The combination of the stiffener element and the item of Wearing apparel is foldable along the score line so that the combination takes on a greeting card shape comprising a front facing planar surface, at least two interior planar surfaces and a back facing planar surface. At least one of the planar surfaces comprises a portion of the item of wearing apparel which is disposed flat against the stiffener element with at least a portion of the wearing apparel design disposed in the planar surface in such a way that the wearing apparel design forms an integral part of the greeting card design.

In one embodiment, the item of wearing apparel is a T-shirt having some sort of written message applied to its front. The stiffener element is an approximately rectangular piece of light cardboard having a longitudinal score line disposed approximately along the longitudinal axis of the stiffener element and a transverse score line disposed approximately along the transverse axis of the stiffener element. The T-shirt is disposed over the stiffener element and the stiffener element is folded first along the transverse score line and then along the longitudinal score line to form a greeting card-shaped structure having at least four planar surfaces (a front facing surface, two interior surfaces and a back facing surface). Each of the surfaces comprises a portion of the item of wearing apparel and the combination is foldable so that a portion of the message on the front of the T-shirt can be disposed on one or both of the interior planar surfaces to form the interior message of the greeting card.

The invention is also a combination of the novelty greeting card described above and a mailing envelope.

The invention is also a kit comprising the novelty greeting card described above, a mailing envelope and marking means suitable for the free-hand creation of the wearing apparel design.

The novelty greeting card of the invention provides a unique gift idea. The novelty greeting card of the invention is fun to send to a relative, friend or loved one in lieu of sending a conventional greeting card. After the greeting card is received, the item of wearing apparel can be removed from the stiffener element and worn by the recipient with at least a portion of the greeting card message retained and displayed on the item of wearing apparel.

DESCRIPTION OF THE DRAWINGS

These and other features, aspects and advantages of the present invention will become understood with reference to the following description, appended claims and accompanying drawings where:

FIG. 10 is a front view of the novelty greeting card of FIG. 9 illustrating how one corner of the card is folded along a score line;

FIG. 11 is a front view of the novelty greeting card of FIGS. 9 and 10 illustrating how three of the four corners can be folded along score lines;

FIG. 12 is a cross-sectional view of the novelty card of FIG. 10 along line 12—12;

FIG. 13 is a front view of the fully folded novelty greeting card of FIGS. 9, 10, 11 and 12 and 13 illustrating how the combination could be inserted into an envelope for mailing;

FIG. 16 is a perspective view of the novelty greeting card of FIGS. 14 and 15 illustrating how the novelty greeting card can be folded along a score line;

FIG. 17 is a perspective view of the novelty greeting card of FIGS. 14, 15 and 16 illustrating how the fully folded combination can be inserted into an envelope for mailing; and FIG. 18 is a cross-sectional view of the novelty greeting card of FIG. 17 along line 18—18.

DESCRIPTION OF THE INVENTION

Figure 1:
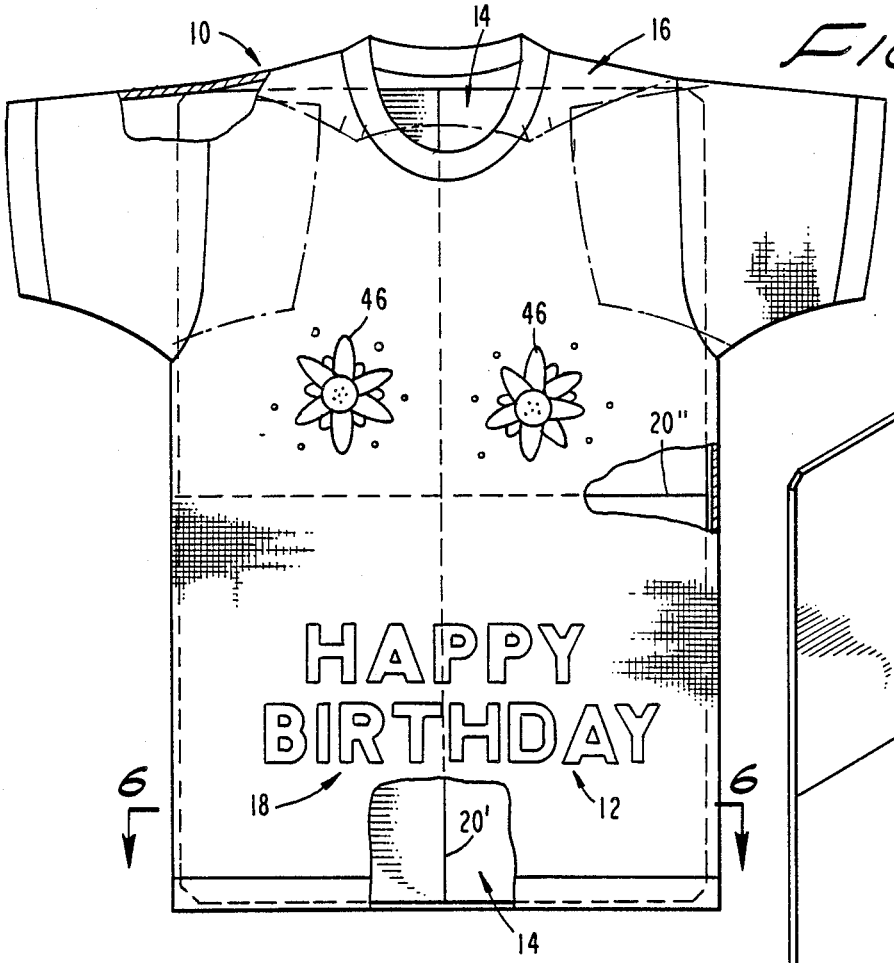
FIG. 1 is a front view of a novelty greeting card having features of the invention and demonstrating how the stiffener element can be disposed within the item of wearing apparel.

The invention is a novelty greeting card 10 having a greeting card design 12 and comprising a stiffener element 14 and an item of wearing apparel 16.

The greeting card design 12 can comprise any combination of words or purely ornamental features. In a typical embodiment, the greeting card design 12 comprises a written message.

The item of wearing apparel 16 can be any item of clothing which can be combined with the stiffener element 14 to form the novelty greeting card of the invention 10. The item of wearing apparel 16 can be a shirt or blouse, shorts, skirt, a sock or other item of hosiery, a handkerchief or a scarf. The item of wearing apparel can even be an undergarment. The item of wearing apparel 16 can also be some other sewn cloth product "wearable" by an inanimate object, such as a pillowcase. In a typical embodiment, the item of wearing apparel 16 is a man's or woman's T-shirt.

The item of wearing apparel 16 has a wearing apparel design 18. Like the greeting card design 12, the wearing apparel design 18 can comprise words or purely ornamental features. In a typical embodiment, the wearing apparel design 18 comprises a written message.

The wearing apparel design 18 can be disposed onto the item of wearing apparel 16 by any of the numerous methods known to practitioners in the art. For example, the wearing apparel design 18 can be silk-screened onto the item of wearing apparel 16. Also, the wearing apparel design 18 can be attached to the item of wearing apparel 16 as emblems and patches. The wearing apparel design 18 can also be written upon the item of wearing apparel 16 by use of a marking pen or some other kind of marker, and the wearing apparel design 18 can be embroidered onto the item of wearing apparel 16. Furthermore, the wearing apparel design 18 can also be knitted or woven into the fabric comprising the item of wearing apparel 16 using different colors of thread or yarn.

The stiffener element 14 can be made out of any suitable planar material such as heavy paper, flexible plastic or like metal. The stiffener element material can also be a combination of several suitable materials. In a preferred embodiment, the stiffener element 14 is made out of a thin cardboard.

The stiffener element 14 has at least one score line 20 to facilitate the folding of the stiffener element 14 into the greeting card shape.

The greeting card shape can be any shape which gives the novelty greeting card 10 the general appearance of a conventional greeting card. In a typical embodiment, the greeting card shape comprises at least a pair of planar elements 22 joined together along a common edge 24 and has at least four four planar surfaces 26: a front facing surface **26*f*, a back facing surface 26*b* and two interior surfaces 26*i***.

Figure 7:
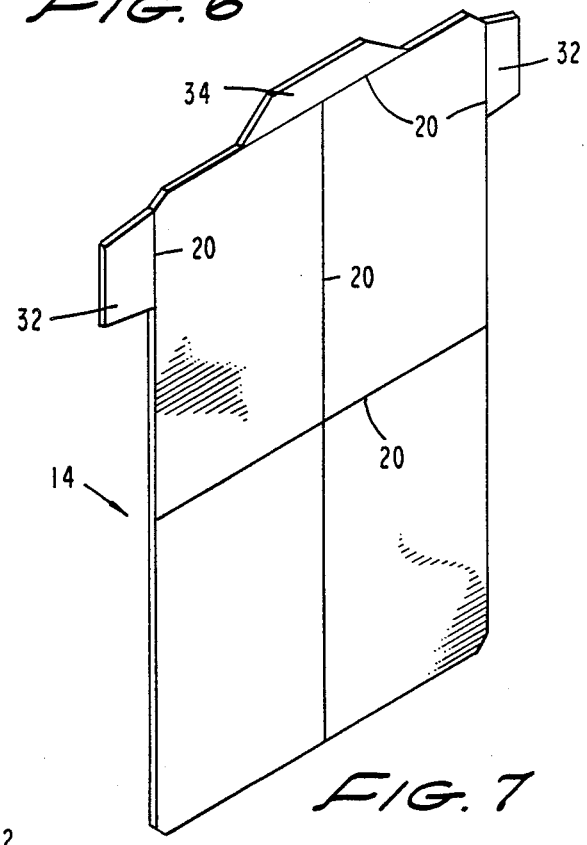
FIG. 7 is a perspective view of a second stiffener element useful in the invention.

As illustrated in FIG. 7, the stiffener element 14 can also comprise one or more limb protrusions 32 and/or a neck protrusion 34 to better conform the stiffener element 14 to the arm, leg and/or neck portions of the item of wearing apparel 16. In the embodiment illustrated in FIG. 7, an additional score line 20 is disposed between each protrusion 32 or 34 and the remainder of the stiffener element 14 to facilitate the folding of each protrusion 32 or 34 towards the remainder of the stiffener element 14.

In the embodiment of the novelty greeting card 10 shown in FIGS. 14–18, the stiffener element 14 has a single transverse score line 20 so that the novelty greeting card 10 can be folded once.

Figure 2:
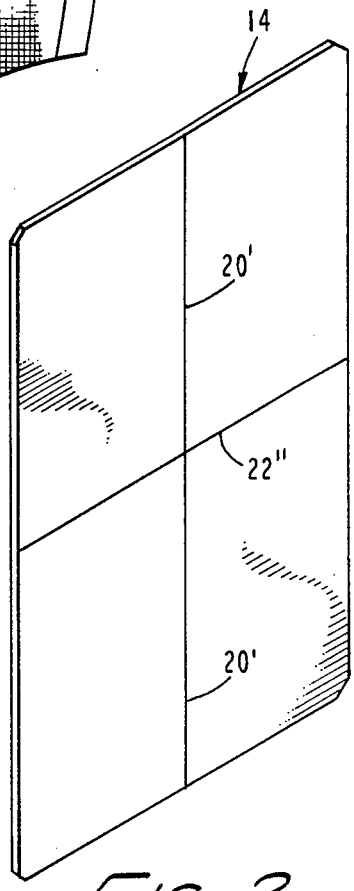
FIG. 2 is a perspective view of a stiffener element useful in the invention.
Figure 3:
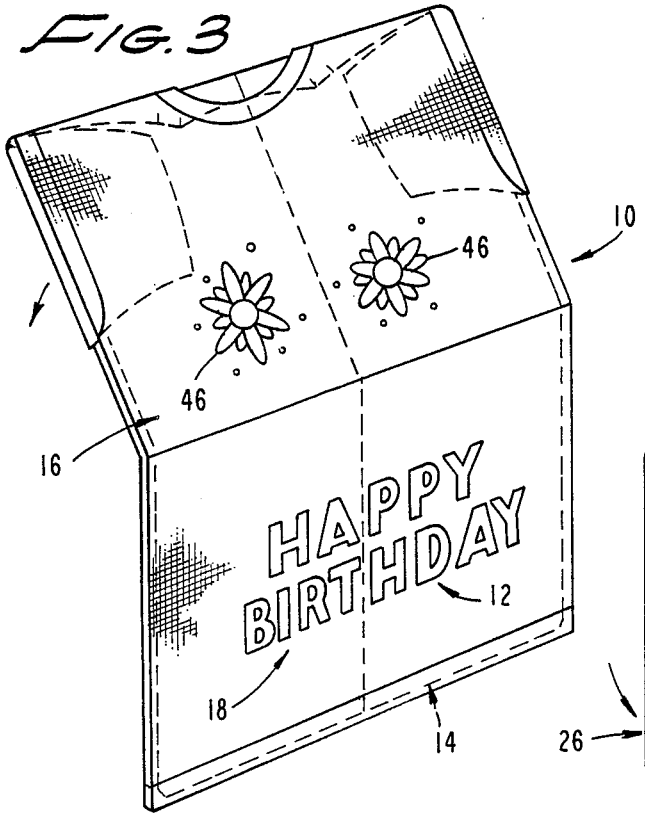
FIG. 3 is a perspective view of the novelty greeting card of FIG. 1 demonstrating how the combination is folded along the transverse score line.
Figure 4:
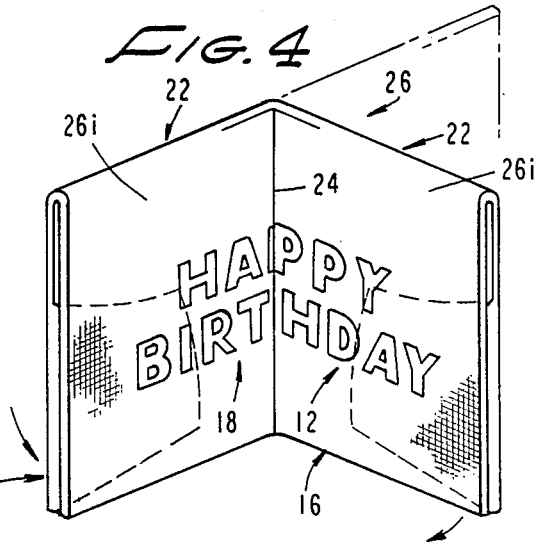
FIG. 4 is a perspective view of the novelty greeting card of FIGS. 1 and 3 illustrating how the combination is folded along the longitudinal score line.
Figure 5:
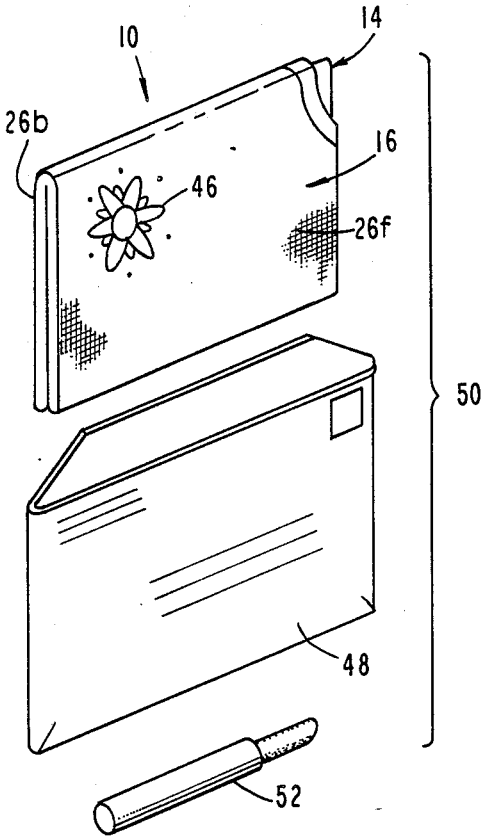
FIG. 5 is a perspective view of the novelty greeting card of FIG. 1 illustrating how the novelty greeting card can be fully folded and inserted into an oversized envelope for mailing and/or combined with an envelope and a marking pen in a kit.
Figure 6:
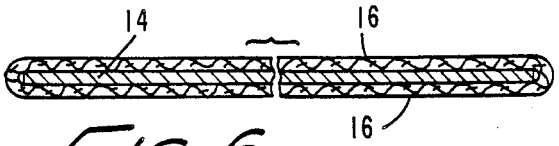
FIG. 6 is a cross-sectional view of the novelty greeting card of FIG. 1 taken along line 6—6.

In the embodiment of the stiffener element 14 illustrated in FIGS. 2 and 7, the stiffener element 14 has two perpendicular score lines 20: a longitudinal score line 20′ disposed approximately along the longitudinal axis of the stiffener element 14 and a transverse score line 20″ disposed approximately along the transverse axis of the stiffener element 14. This facilitates the folding of the novelty greeting card 10 twice as illustrated in FIGS. 3 and 4.

Figure 8:
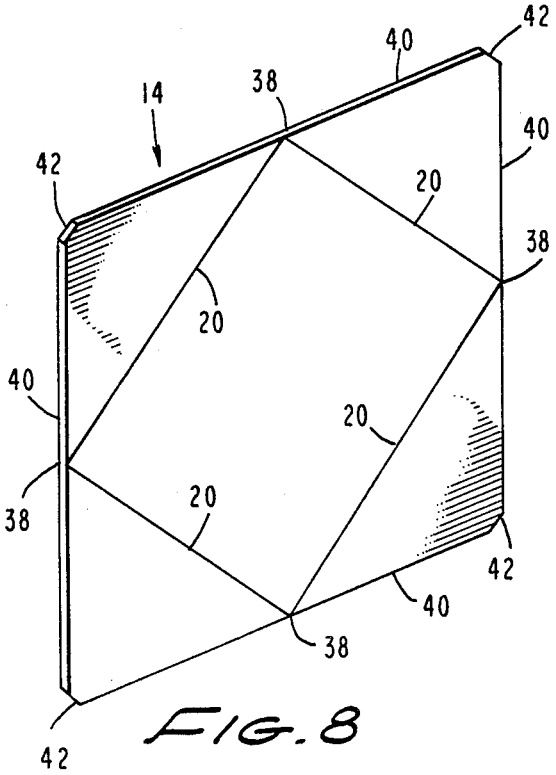
FIG. 8 is a perspective view of a third stiffener element useful in the invention.
Figure 9:
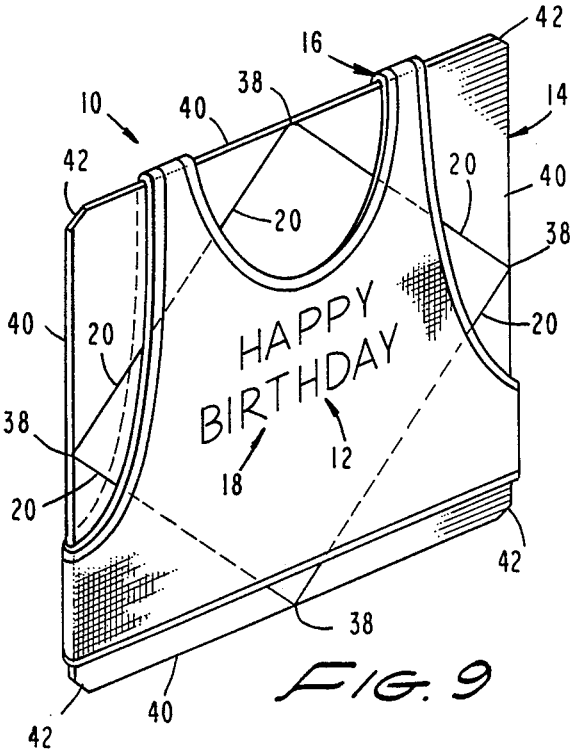
FIG. 9 is a perspective view of a second novelty greeting card of the invention comprising the stiffener element of FIG. 8.
Figure 14:
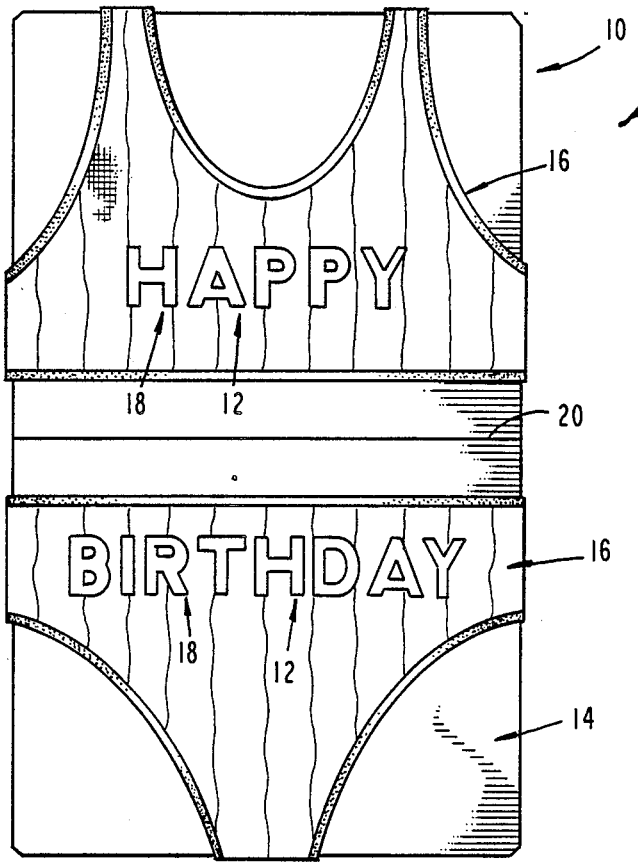
FIG. 14 is a front view of a third novelty greeting card having features of the invention.
Figure 15:
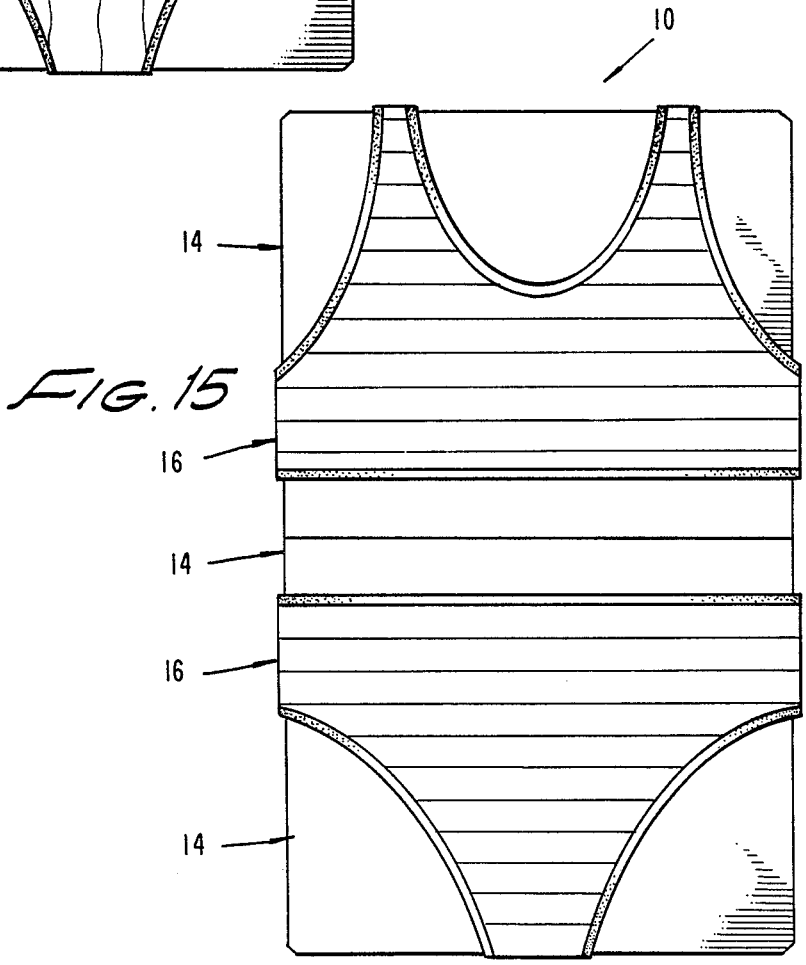
FIG. 15 is a rear view of the novelty greeting card of FIG. 14.

In FIG. 8, another embodiment of the stiffener element 14 is illustrated. In this embodiment, the stiffener element 14 has a rectangular shape and comprises four score lines 20 disposed together to form the shape of a diamond on the stiffener element 14 with each of the four diamond points 38 disposed approximately at the midpoint of one of the sides 40 of the stiffener element 14. The stiffener element 14 illustrated in FIG. 8 is foldable as illustrated in FIGS. 10, 11, 12 and 13 so that each of the four corners 42 of the stiffener element 14 is folded towards the center of the stiffener element 14 with each corner 42 convergent to the midpoint of the stiffener element 14. Similar stiffener elements 14, but having other regular geometric shapes, can also be used.

The stiffener element 14 is disposed inside the item of wearing apparel 16.

The item of wearing apparel 16 is attached within the stiffener element 14 by any standard means of attachment which allow for the non-destructive removal of the item of wearing apparel 16 from the stiffener element 14 by the recipient of the novelty greeting card 10. For example, the item of wearing apparel 16 can be attached by such standard methods as water soluble and non-staining glue, by staples, by ribbon and by thread. The item of wearing apparel 16 can also be merely slipped over the stiffener element 14 without the use of additional attaching means, especially if the item of wearing apparel 16 is relatively elastic and the stiffener element 16 is slightly larger than the fully-relaxed dimensions of the item of wearing apparel 16 (so that the item of wearing apparel 16 conforms snugly to the stiffener element 14 without further attachment means).

At least one of the planar surfaces 26 of the novelty greeting card 10 comprises the item of wearing apparel 16 disposed flat against the stiffener element with at least a portion of the wearing apparel design 18 disposed in the planar surface 26 in such a way that the wearing apparel design 18 forms an integral part of the greeting card design 12. In a preferred embodiment, the greeting card design 12 comprises a written message, the wearing apparel design 18 comprises a written message and the wearing apparel message is an integral part of the greeting card message. For example, in FIGS. 1, 3 and 4, the item of wearing apparel 16 comprises two flower-like ornamental designs 46 and the words "Happy Birthday." When folded along the score lines 20 to form a greeting card shape, one of the flower designs 46 is disposed on the front facing planar surface **26*f* and the other flower design 46 is disposed on the back facing planar surface 26*b*. The words "Happy Birthday" are disposed on the two interior planar surfaces 26*i***.

The item of wearing apparel 16 can substantially cover all of the planar surfaces 26 comprised in the greeting card shape, as illustrated in FIG. 4, or the item of wearing apparel 16 can cover only a portion of one or more of the planar surfaces 26 as illustrated in FIG. 16.

The novelty greeting card 10 can be mailed or otherwise delivered to a recipient in an ordinary mailing envelope 48. Preferably the envelope 48 is shaped similarly to that of an ordinary envelope traditionally sold with conventional greeting cards.

The novelty greeting card 10 can be marketed as part of a kit 50 comprising the novelty greeting card 10, the envelope 48 and a marking pen 52 or other suitable marking means for custom creating the wearing apparel design. Such a kit 50 allows the purchaser to create his or her own special wearing apparel message or other design.

The novelty greeting card of the invention provides a truly unique way of sending a brief message to a friend, family member or other loved one. The invention provides not only the fun of giving and receiving a truly unique gift, but it also provides for the additional enjoyment of allowing the receiver to wear the greeting card message long after the gift is given.

Although the present invention has been described in considerable detail with reference to certain preferred versions, many other versions are possible. Therefore, the spirit and scope of the appended claims should not necessarily be limited to the foregoing description of the preferred versions contained herein.

I claim:

1. A novelty greeting card having a greeting card design comprising a combination of a stiffener element disposed in an item of wearing apparel, wherein:

(a) the stiffener element has at least one score line to facilitate the folding of the stiffener element;

(b) the item of wearing apparel comprises a wearing apparel design and is attached to the stiffener element;

(c) the combination is foldable along the score line so that the combination can assume a greeting card shape comprising a front facing planar surface, at least two interior planar surfaces and a back facing planar surface; and (d) at least one of the planar surfaces comprises a portion of the item of wearing apparel disposed flat against the stiffener element with at least a portion of the wearing apparel design disposed in the planar surface in such a way that the wearing apparel design forms an integral part of the greeting card design.

2. The novelty greeting card of claim 3 wherein the stiffener element comprises at least one limb protrusion and at least one additional score line to facilitate the folding of the limb protrusion against the remainder of the stiffener element.

3. The novelty greeting card of claim 1 wherein the stiffener element comprises a neck protrusion and at least one additional score line to facilitate the folding of the neck protrusion against the remainder of the stiffener element.

4. The novelty greeting card of claim 1 comprising at least two score lines disposed perpendicular to one another.

5. The novelty greeting card of claim 1 wherein the stiffener element is rectangularly shaped and wherein the stiffener element comprises at least four score lines disposed together to form the shape of a diamond with each of the four diamond points disposed approximately at the midpoint of one side of the stiffener element, and so that the four corners of the stiffener element are readily foldable towards the center of the stiffener element with each corner convergent to the midpoint of the stiffener element.

6. The novelty greeting card of claim 1 wherein the item of wearing apparel is a shirt.

7. The novelty greeting card of claim 1 wherein the item of wearing apparel is a T-shirt.

8. The novelty greeting card of claim 1 wherein the greeting card shape comprises a pair of identical rectangles joined together along one edge of each rectangle at a score line.

9. The novelty greeting card of claim 1 wherein the greeting card design comprises a written message.

10. The novelty greeting card of claim 1 wherein the wearing apparel design comprises a written message.

11. The novelty greeting card of claim 1 wherein the greeting card design comprises a written message, the wearing apparel design comprises a written message and the wearing apparel design written message is an integral part of the greeting card design written message.

12. The novelty greeting card of claim 1 wherein the item of wearing apparel substantially covers all of the planar surfaces comprising the greeting card shape.

13. A combination of the novelty greeting card of claim 1 disposed within an envelope.

14. A kit comprising the novelty greeting card of claim 1, an envelope, and marking means for creating the wearing apparel design.

* * * * *